United States Patent [19]

Ford

[11] Patent Number: 4,685,830

[45] Date of Patent: Aug. 11, 1987

[54] MINESHAFT CLOSURES

[76] Inventor: Robert E. Ford, Plas-y-Glynn, Glyndyfrdwy, Nr. Llangollen, Clwyd, Wales

[21] Appl. No.: 796,404

[22] Filed: Nov. 8, 1985

[30] Foreign Application Priority Data

Nov. 9, 1984 [GB] United Kingdom ..... 8428332

[51] Int. Cl.[4] ..... E21D 1/00

[52] U.S. Cl. ..... 405/133; 166/135; 405/132

[58] Field of Search ..... 405/132, 133; 166/75.1, 166/97, 95, 92, 118, 135

[56] References Cited

U.S. PATENT DOCUMENTS

| | | | |
|---|---|---|---|
| 376,010 | 1/1888 | Redline | 166/75.1 X |
| 2,577,610 | 12/1951 | Deupree | 166/135 |
| 3,039,534 | 6/1962 | Koop | 166/135 X |
| 3,126,827 | 3/1964 | McReynolds | 166/135 X |
| 3,362,478 | 1/1968 | McReynolds | 166/135 X |
| 3,451,583 | 6/1969 | Lee | 138/89 X |

FOREIGN PATENT DOCUMENTS

| | | | |
|---|---|---|---|
| 125383 | 11/1931 | Austria | 166/135 |
| 1586238 | 3/1981 | United Kingdom | 405/133 |

*Primary Examiner*—Dennis L. Taylor

*Attorney, Agent, or Firm*—Fleit, Jacobson, Cohn & Price

[57] ABSTRACT

The present specification discloses a disclosure for sealing off dis-used open mineshafts. The closure comprises an open topped basket-like framework which has a polygonal shape with a side wall which tapers from the open top towards the base of the basket-like framework. The base has a conical shape with the apex of the conical shape extending inwardly of the basket. When at least partially filled with infill, the conical base positions the infill adjacent to the side wall and tends to force the side wall outwards, securing the basket-like framework in a mineshaft.

6 Claims, 1 Drawing Figure

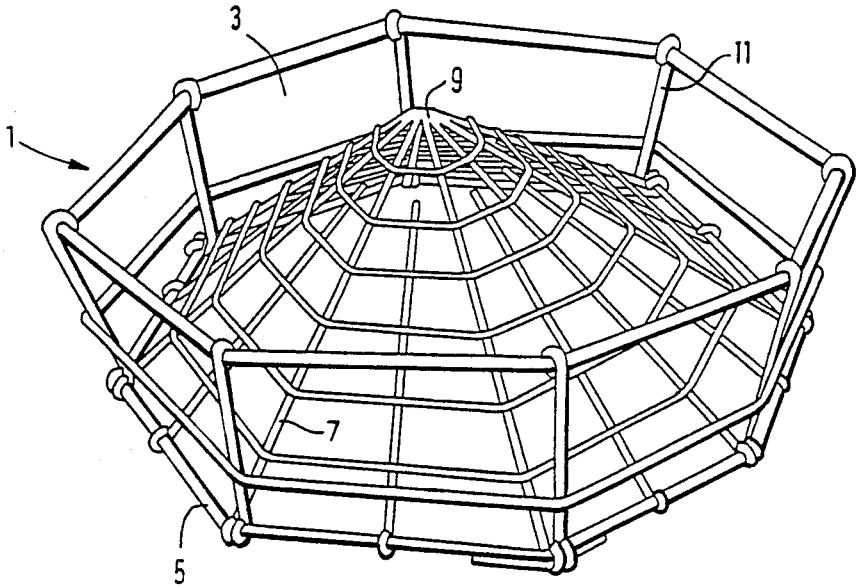
3
11
9
1
7
5

MINESHAFT CLOSURES

The present invention relates to a closure for sealing off dis-used open mineshafts.

More particularly, the present invention relates to a mineshaft closure of the type disclosed in my British Pat. No. 1 586 238. These mineshaft closures basically comprise a stabiliser in the form of a basket-like framework which is slightly tapered and which locates in the mineshaft, the stabiliser being preferably loaded with suitable material and thereby deformed to grip the mineshaft, and a minecap to cover the shaft. The stabiliser and minecap can be integrally interconnected though usually they are installed as separate parts, the stabiliser being located at any suitable depth in the mineshaft. The purpose of the stabiliser is to prevent the shaft from caving in so that the minecap remains in the installed position.

The stabiliser may be almost any shape e.g. hexagonal, octagonal, square, rectangular, oval or round. Each stabiliser is custom built to suit an individual shaft.

Whilst a stabiliser may merely be located in a mineshaft and left empty, the stabiliser is, as previously stated, preferably loaded with a suitable material. Boulders etc. may be used to load the stabiliser. However it has been found that Local Authorities prefer to fill the stabilisers with concrete, both for simplicity and also to create employment. Whilst stabilisers can be constructed accordingly, when it is known in advance that they are to be filled with rocks and/or concrete, if too much weight e.g. Ready-Mix concrete, is placed in a stabiliser too quickly, its shape can change and the shopping-bag effect (as it has become known) can happen i.e. the weight deforms the base of the stabiliser basket downwards, drawing the sides of the stabiliser so that it disengages from the mineshaft wall and drops down the shaft.

To reduce the likelihood of the above happening, the stabiliser basket framework can be made from stronger metal sections than normally required. However, this is expensive and also results in a very heavy article which presents transport and installation problems.

The aim of the present invention is to provide a strong stabiliser which overcomes the above problems.

According to the present invention there is provided a closure for a mineshaft comprising a stabiliser in the form of a basket-like framework having a conically shaped base, the apex of the conical shape projecting into the basket.

Thus with a stabiliser constructed accordingly to the present invention, the conically-shaped base reduces the available space for concrete in-full etc., and positions the concrete poured into the basket, where it is needed, adjacent the walls of the shaft. Further the conically shaped base of the framework increases the strength of the stabiliser preventing the shopping-bag effect from happening. Additionally this design can in many instances be made much lighter than an equivalent size stabiliser with a flat base, and with equivalent strength.

When used on shafts where one dimension of the stabiliser is less than one dimension of the shaft (i.e. width), then laterally extending legs are preferably provided on the stabiliser to prevent losing the stabiliser down a shaft while positioning the stabiliser in the mouth of a shaft.

The present invention will now be further described, by way of example, with reference to the accompanying drawing in which a preferred embodiment of the present invention, is illustrated in perspective.

The closure illustrated in the accompanying drawing comprises a stabiliser basket framework (1) made from reinforcing metal bar (or similar) of 12 mm or 16 mm diameter steel bar. The basket (1) is octagonal and designed to taper inwardly from open end (3) to the base region (5). The base (7) of the basket (1) is conical in shape, the apex (9) of the conical base (7) extending inwardly of the basket.

With the stabiliser design of the present invention any in-fill e.g. boulders, concrete etc., is automatically positioned by the conical base (7), in the optimum position i.e. away from the centre of the basket (1) and adjacent to the walls (11) of the basket (1). Thus the in-fill is located adjacent the mineshaft wall.

Further, the conical base (7) provides extra strength to the basket (1), preventing the shopping bag effect from occurring when the in-fill is rapidly introduced into the basket (1). Additionally it has been found that due to the extra strength provided by the conical design of the base (7), the framework can be made lighter than in previous constructions.

The present invention thus provides a stronger more efficient stabiliser for use in closing a mineshaft. To further aid the installation of the stabiliser of the present invention, lateral legs (not shown) can be provided to prevent the stabiliser from falling down a shaft. Further, the pivotal claw legs of my British patent application No. 8319194, can readily be used in the illustrated preferred embodiment of the present invention or in any other presently envisaged embodiment of the present invention.

I claim:

1. A closure for a mineshaft comprising a stabiliser in the form of a deformable basket-like framework having an outer wall tapering inwardly from an open top to a base region of a conically shaped base, said conically shaped base projecting from said base region to its apex into the basket in a direction opposite to the inward taper of said outer wall for positioning fill in material adjacent to the walls of the mineshaft.

2. A closure according to claim 1, wherein the basket is open topped and has an outer wall which tapers inwardly from its open end to the base.

3. A closure according to claim 1, wherein the basket-like framework is polygonal in shape.

4. A closure according to claim 2, wherein the basket-like framework is polygonal in shape.

5. A closure as claimed in claim 1 in which the basket is made from 12 mm or 16 mm steel bar.

6. A closure as claimed in claim 1 when at least partially filled with a suitable in-fill, the in-fill surrounding the conical shape of the base.

* * * * *